US006494445B1

(12) United States Patent
Bellis, Jr.

(10) Patent No.: US 6,494,445 B1
(45) Date of Patent: Dec. 17, 2002

(54) CLAMP ASSEMBLY

(76) Inventor: William B. Bellis, Jr., 1401 Schutt Ln., Louisville, KY (US) 40205

( * ) Notice: Subject to any disclaimer, the term of this patent is extended or adjusted under 35 U.S.C. 154(b) by 0 days.

(21) Appl. No.: 09/947,847

(22) Filed: Sep. 6, 2001

(51) Int. Cl.[7] ..... B25B 1/22

(52) U.S. Cl. ..... 269/71; 269/68; 269/69; 269/4; 269/59

(58) Field of Search ..... 269/71, 4, 6, 55, 269/56, 58, 63, 69, 82, 203, 282

(56) References Cited

U.S. PATENT DOCUMENTS 3,514,091 A * 5/1970 Johnson et al. ..... 269/68
3,981,491 A * 9/1976 Snyder ..... 269/64
4,058,302 A * 11/1977 Barrowcliff ..... 269/76
4,253,648 A * 3/1981 Meeks ..... 269/4
5,141,211 A * 8/1992 Adams ..... 269/16
D356,901 S * 4/1995 Schoenig ..... D6/400
6,024,348 A * 2/2000 Ventura ..... 269/17

OTHER PUBLICATIONS

Park Tool USA, Sales Brochure St. Paul, Minnesota US Printed May, 2001.

* cited by examiner

*Primary Examiner*—Joseph J. Hail, III
*Assistant Examiner*—Daniel Shanley
(74) *Attorney, Agent, or Firm*—Theresa Fritz Camoriano; Guillermo E. Camoriano

(57) ABSTRACT

A clamp assembly has a separate and independent clamp stand base, such that several clamp stand bases may be mounted on desired surfaces at various locations, and the clamp may be moved from one clamp stand base to another for quick and easy mounting at the different locations, and to minimize the number of clamps required to service of all of these different locations. The assembly permits the position of the clamp to be adjusted relative to the stand by pivoting and by raising and lowering the clamp relative to the base.

12 Claims, 4 Drawing Sheets

CLAMP ASSEMBLY

BACKGROUND OF THE INVENTION

The present invention relates to a clamp assembly for securing tools to work surfaces. It is often desirable to be able to temporarily mount a tool at various locations by clamping the tool in place. For example, it may be desirable to mount the tool on a work bench, for working on the tool, on a vehicle, for carrying the tool out to a job site, and so forth.

SUMMARY OF THE INVENTION

The present invention provides a clamp with a separate, independent, and interchangeable clamp stand base. The clamp stand base is, by itself, very small and unobtrusive. It mounts readily to most surfaces and remains very much out of the way until it is needed. The clamp mounts directly, quickly, and securely to the clamp stand base, and this mounting is multi-directional and height adjustable for maximum versatility in accommodating many types of tools to many types of surfaces. Since the clamps and clamp stand bases are completely interchangeable, the user may purchase a single clamp and a number of clamp stand bases, then move the clamp from one base to another as needed.

DESCRIPTION OF THE PREFERRED EMBODIMENT

Figure 1:
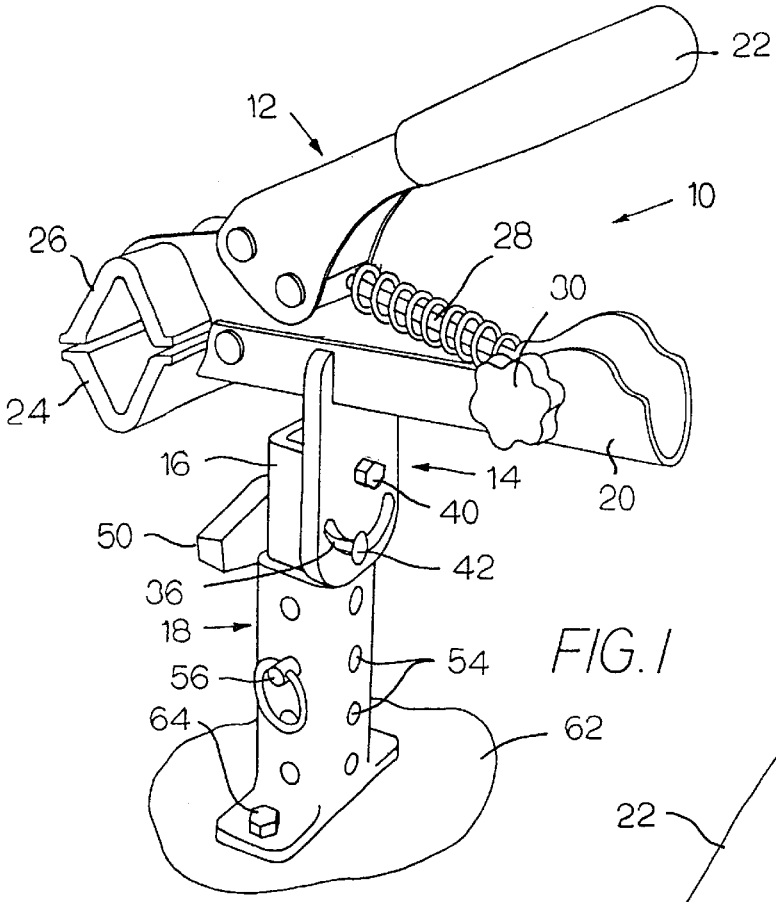
FIG. 1 is partially cut away, perspective view of multi-purpose clamp and stand made in accordance with the present invention, with the clamp jaws drawn closed.

FIGS. 1–7 show a first preferred embodiment of a multi-purpose clamp assembly 10, made in accordance with the present invention. The clamp assembly 10 includes a clamp 12, which has a projection 14, that is pivotably connected to a clamp stand. The clamp stand includes a stationary base member 18 and a movable member 16.

Figure 4:
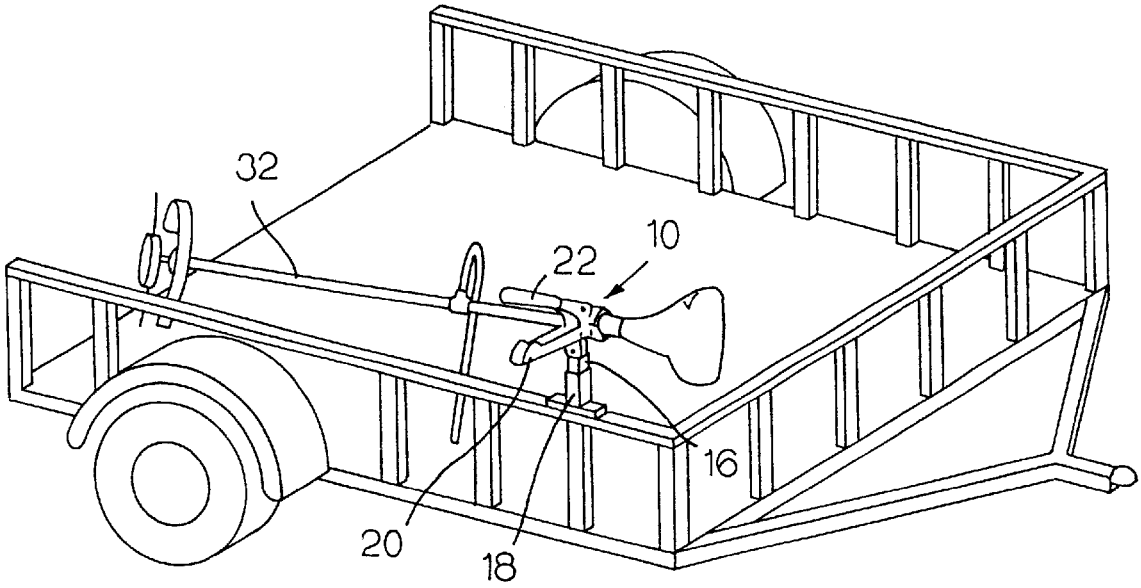
FIG. 4 is perspective view of the clamp assembly of FIG. 1 mounted on a trailer and holding a trimmer in place.
Figure 5:
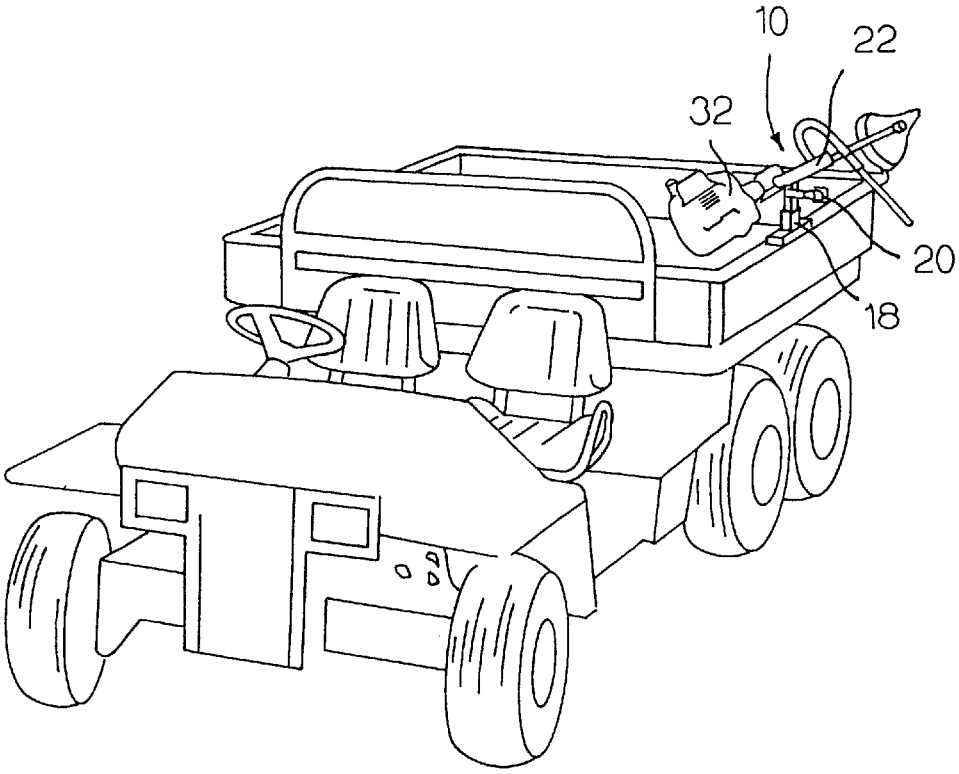
FIG. 5 is a perspective view of the clamp assembly of FIG. 1 mounted on a utility cart and holding a trimmer in place.
Figure 6:
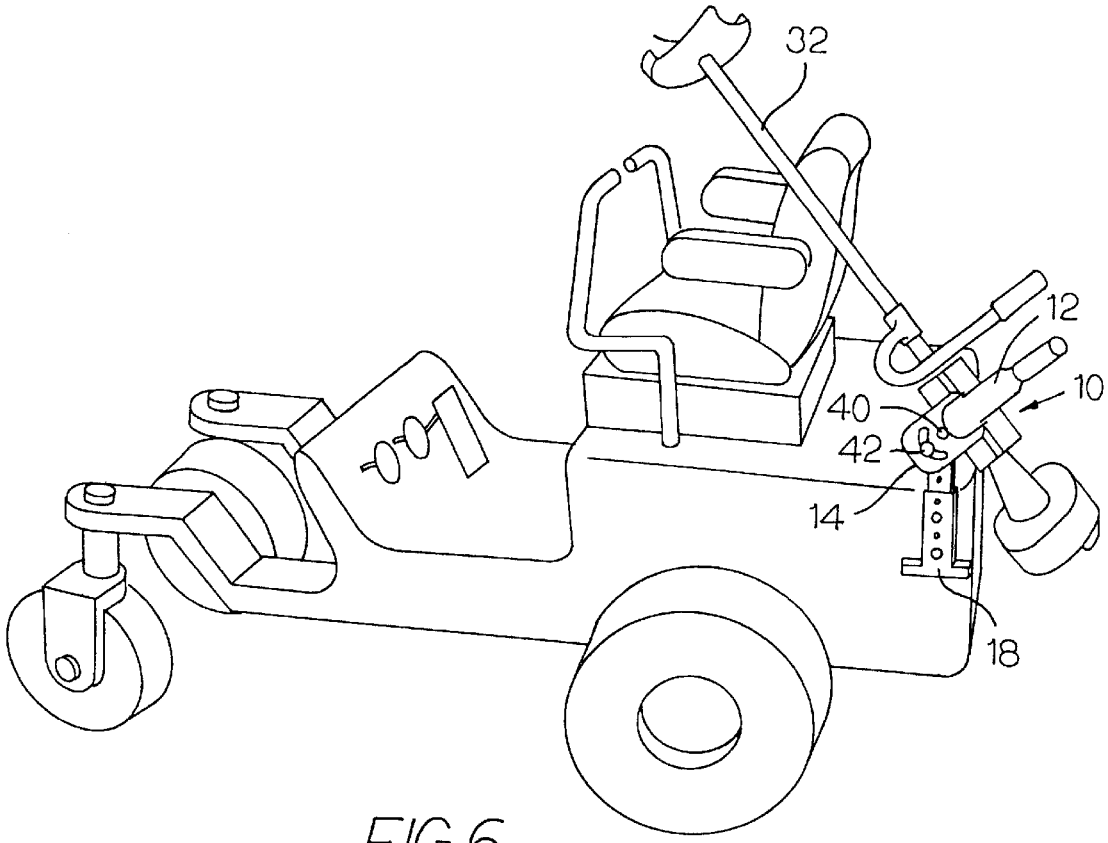
FIG. 6 is a perspective view of the clamp assembly of FIG. 1 mounted on a riding mower and holding a trimmer in place, with the clamp at a 45 degree angle; and, FIG. 7 is a partially broken away, detailed side view of the pivot connection of the clamp assembly of FIG. 6, with the clamp pivoted at a 45 degree angle relative to the base.

The clamp 12 uses a standard clamping mechanism, known in the art, similar to a pair of lock-grip pliers, including a fixed handle 20, a pivotable lever 22, a pair of jaws 24, 26, and a spring-biased connecting rod 28 linking the handle 20 to the lever 22. The length of the connecting rod 28 may be adjusted via an adjustment knob 30 to set how far the jaws 24, 26 come together to clamp tightly on a tool when the lever 22 is pulled together toward the handle 20. In this embodiment 10, the jaws 24, 26 are replaceable, are made out of a cushioning material, such as rubber, and are elongated in a direction perpendicular to the direction of the clamping motion in order to provide a good grip on a tool such as the handle of a trimmer 32 as shown in FIGS. 4, 5, and 6.

A projecting ear 14 is fixed to the handle 20 (in this preferred embodiment by welding). The projecting ear 14 defines a circular pivot hole 34 and an arcuate slide slot 36 (See FIGS. 3 and 7). The slide slot 36 describes a 90 degree arc which is concentric with the pivot hole 34. A first bolt 40 extends through the pivot hole 34, and a second bolt 42 extends through the slide slot 36 as will be explained in more detail later.

Figure 7:
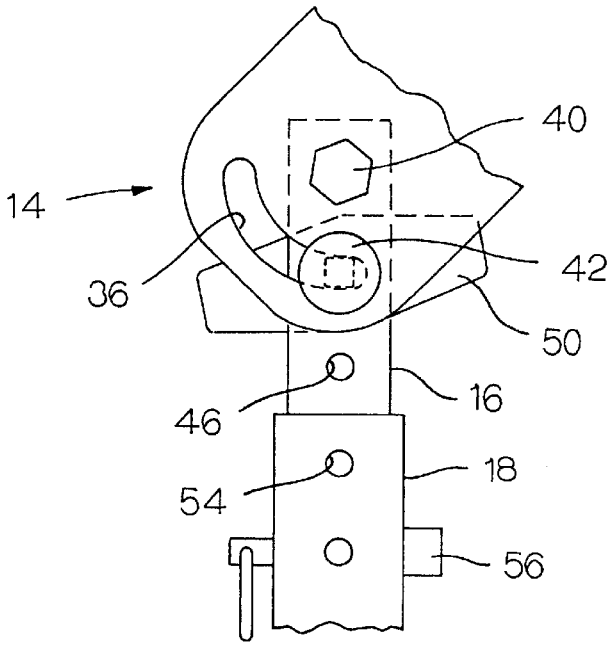

The projecting ear 14 mounts onto the movable portion 16 of the clamp stand. The movable portion 16 is a square tubular member 44, with a plurality of through holes 46 equally spaced along all four long sides. The bolts 40, 42 extending through the pivot hole 34 and slide slot 36 align with the holes 46 at least at the top of the movable portion 16 of the clamp stand. The clamp 12 is pivotably mounted onto the movable member 16 by running the first bolt 40 through the pivot hole 34 and through the top set of holes 46A in the movable member 16 and securing these with a nut 48. The first bolt 40 or other fastener then becomes the pivot axis. The second bolt 42 extends through the slide slot 36 and through the next-to-the-top set of holes 46B in the movable member 16 and is secured with another nut 50, which may be a wing nut having an enlarged handle portion, as depicted in the figures. By loosening the wing nut 50, the clamp 12 may be pivoted about the bolt 40 until the second bolt 42 hits against one of the ends of the slide slot 36 (as shown in FIG. 7). This allows the clamp 12 to pivot, relative-to the projecting member 16, as much as the slide slot 36 will permit, which is as much as 90 degrees in the case of a slide slot 36 with a 90 degree arc. Once the clamp 12 is pivoted to the desired position, the handle 50 is tightened, locking the clamp 12 in position.

Figure 3:
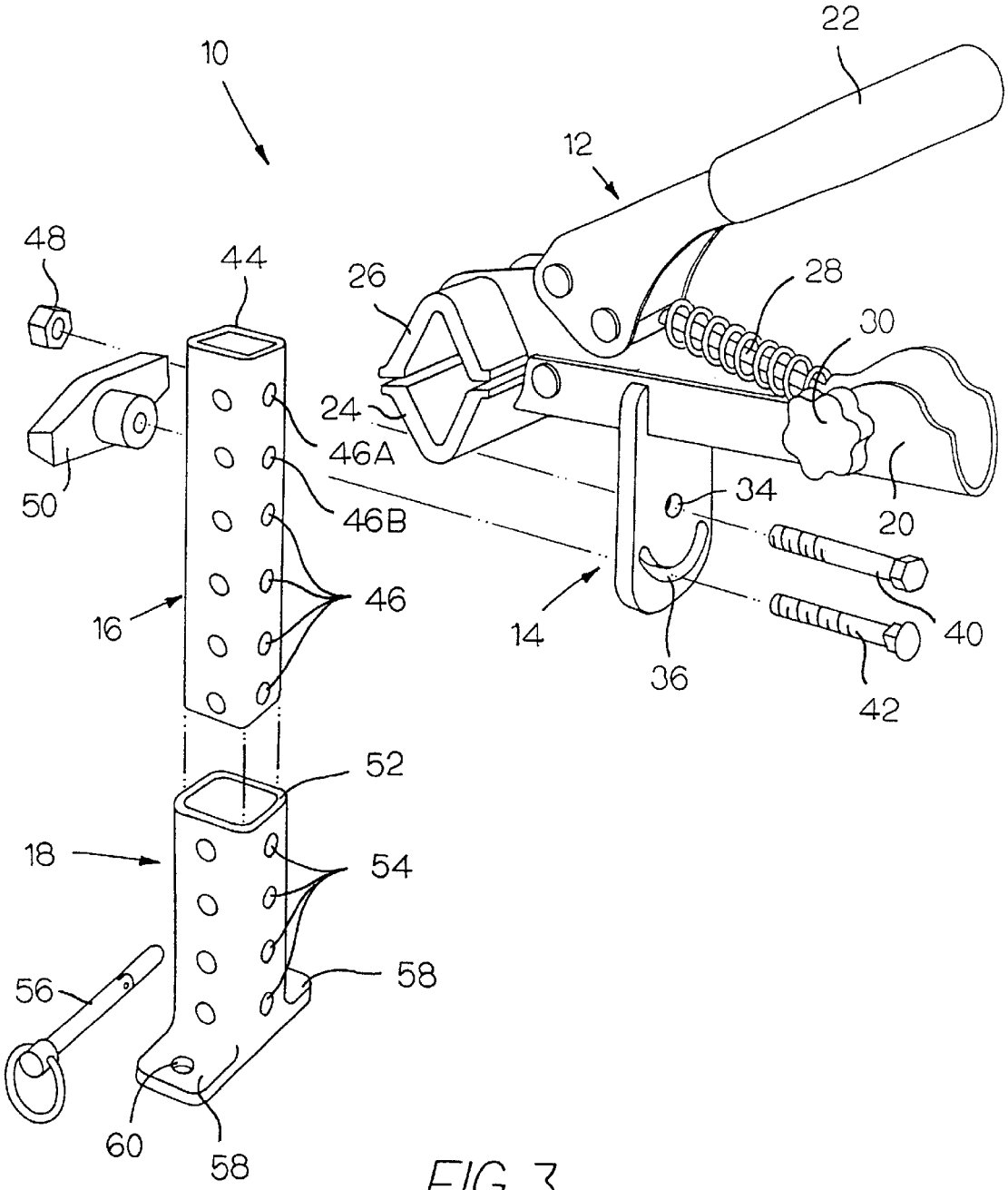
FIG. 3 is an exploded perspective view of the clamp assembly of FIG. 1.

Referring to FIG. 3, the movable member 16 is telescopically received in the stationary member 18, which is another hollow square tubular member 52, having an internal profile which closely matches the external profile of the movable member 16. A plurality of equally spaced holes 54 run along all four sides of the tubular frame 52, and the distance between two adjacent holes 54 in the stationary member 18 is equal to the distance between two adjacent holes 46 in the movable member 16. Thus, the relative vertical positions of the movable member 16 and the stationary member 18 may be adjusted by aligning the desired set of holes and inserting a locking pin 56 through the aligned holes. While this embodiment has the projecting member 16 received inside the fixed member 18, and this arrangement is preferred, the fixed member 18 could instead be sized to be received inside the projecting member 16.

Figure 2:
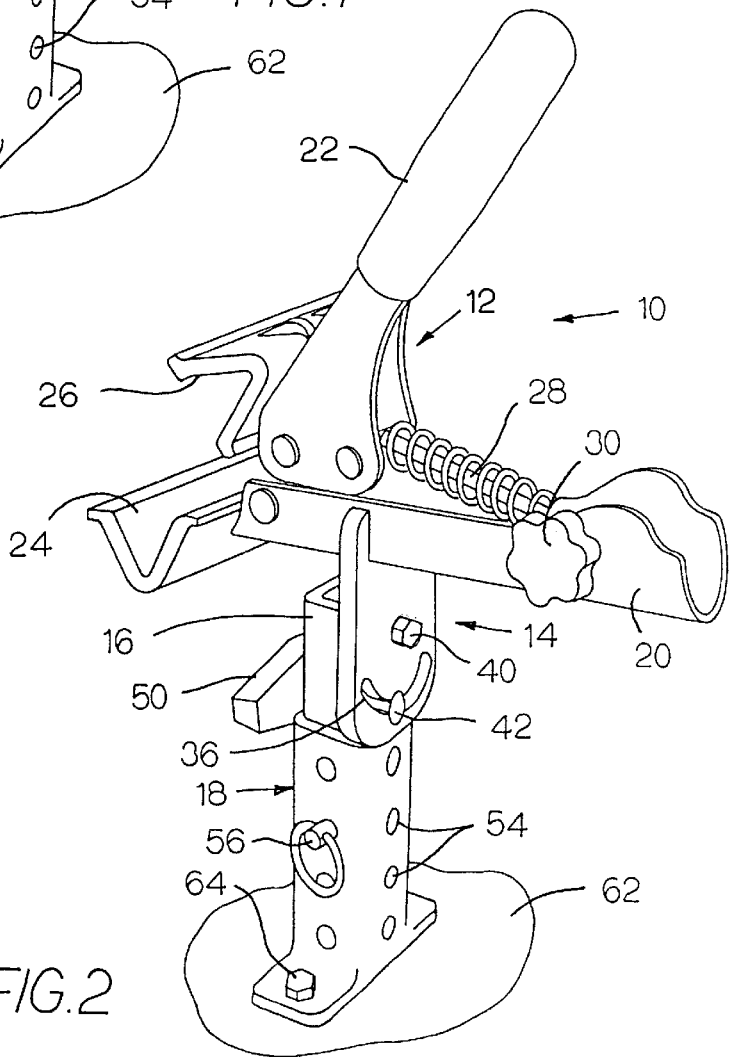
FIG. 2 is the same view as in FIG. 1 except that the clamp jaws are drawn open.

The fixed member 18 has two sets of opposite sides. Two opposed, outwardly projecting feet 58 extend from a first set of said opposite sides. The feet define holes 60 so that the fixed member 18 may be secured to a substantially horizontal surface 62 by means of bolts 64 or other fastening mechanisms, as shown in FIGS. 1 and 2. The other set of opposite sides do not have projecting feet. This permits the fixed member 18 to be secured to a substantially vertical surface by bolting it to the surface through the holes 54, as shown in FIG. 6. The fixed member 18 could alternatively be mounted onto the support surface in a variety of ways, including welding. (It should be noted that reference to vertical and horizontal is just a description of relative positions, because the fixed portion 18 of the mounting base could be mounted in a wide variety of positions, depending upon the orientation of the surface on which it is mounted.

To use the clamp assembly 10, the fixed mounting base member 18 is secured to the selected support surface, such as a work bench, riding mower, utility cart, or the bed of a truck or trailer, or identical fixed members 18 may be mounted to a variety of such surfaces. The movable mounting base member 16 is then inserted into the hollow tubular frame 52 of the selected fixed member 18, such that at least one set of holes 46 on the movable member 16 is aligned with at least one set of holes 54 on the fixed member 18. A locking pin 56 is inserted through the two sets of aligned holes 46, 54 to secure the movable mounting base member 16 to the fixed mounting base member 18. It may also be desired to use two locking pins 56 at right angles at different heights (not shown) for an even more secure attachment. The clamp 12 is attached to the movable mounting base member 16 by inserting the pivot bolt 40 through the pivot hole 34 and through the top set of holes 46A on the projecting member 16, and the locking bolt 42 through the slide slot 36 and through the next-to-the-top set of holes 46B on the projecting member 16, as has already been described. The pivot bolt nut 48 is threaded onto the pivot bolt 40, and the wing nut 50 is threaded onto the locking bolt 42 and tightened in the desired position.

The lever 22 is pulled away from the handle 20 so as to open the jaws 24, 26 of the clamp 10. The tool to be secured, such as the shaft of a trimmer 32, is inserted between the jaws 24, 26, and the clamp is closed by pushing the lever 22 toward the handle 20 until it locks in place. The knob 30 may be rotated to adjust the length of the connecting linkage 28 so that the tool 32 is tightly secured by the clamp 12. The clamp 12 may be pivoted approximately 90 degrees about the pivot axis defined by the bolt 40 (as shown in FIGS. 6 and 7) so as to better accommodate the tool onto the surface by loosening the wing nut 50, pivoting the clamp 12 to the desired angle, and retightening the wing nut 50. The height and orientation of the clamp 12 may also be adjusted by removing the locking pin 56 (or pins 56) and raising, lowering, or re-orienting the movable mounting base member 16 as it is received in the fixed mounting base member 18, and reinserting the locking pin 56.

Once the fixed bases 18 are mounted onto the selected surfaces, it is a straightforward matter to use the multipurpose clamp 10. Simply pull the locking pin 56 and remove the clamp 12 together with the pivot connection 14 and the movable mounting base member 16, and reinstall this assembly into another fixed base member 18. The jaws 24, 26 can be opened or closed by pulling or pushing on the lever 22, and the varying sizes of the tool to be secured can be accommodated by adjusting the length of the connecting linkage 28 with the adjustment knob 30.

This clamp assembly greatly eases and simplifies the securing of tools and other items, such as piping and conduit, to any desired surface. It will be obvious to those skilled in the art that modifications may be made to the embodiments described above without departing from the scope of the present invention.

What is claimed is:

1. A clamp assembly, comprising;

a telescoping clamp stand, including a stationary base member and a movable member, with the fixed base member and movable member being sized to receive each other with a telescoping fit; and a clamp, including a projection defining a pivot hole and an arcuate slot, wherein said movable member of said telescoping clamp stand defines holes aligned with said pivot hole and arcuate slot, respectively;

a pivot fastener extending through said pivot hole and one of said holes in said movable member; and a locking fastener extending through said arcuate slot and another of said holes in said movable member.

2. A clamp assembly as recited in claim 1, wherein said stationary base member of said telescoping clamp stand is a hollow rectangular tubular member defining a plurality of spaced-apart holes, and wherein said movable member of said clamp stand is also a hollow rectangular tubular member, defining a plurality of spaced-apart holes, which align with the holes in said stationary member; and further comprising a locking pin inserted through corresponding aligned holes in said stationary member and said movable member.

3. A clamp assembly as recited in claim 2, wherein said clamp includes first and second jaws and a spring-biased locking mechanism.

4. A clamp assembly as recited in claim 3, and further comprising a second stationary base member, wherein said second stationary base member and said movable member are sized to receive each other with a telescoping fit.

5. A clamp assembly as recited in claim 2, wherein said arcuate slot and said pivot hole are concentric.

6. A clamp assembly, comprising;

a clamp including jaws to clamp onto a tool: a linkage adjustment for adjusting the closed position of said jaws to assure a tight hold on varying tool sizes; and a pivot projection projecting from said clamp and defining a pivot axis and an arcuate slot that is coaxial with said pivot axis;

a clamp stand, including a movable member and a stationary member, wherein said movable member defines a hole aligned with said arcuate slot and includes a locking fastener extending through said hole and said arcuate slot, and wherein said movable member is pivotably connected to said pivot projection such that said clamp is pivotable relative to said movable member about said pivot axis, and said stationary member and said movable member fit together with a telescoping fit.

7. A clamp assembly as recited in claim 6, wherein said stationary member and said movable member of said clamp stand define a plurality of spaced-apart holes, which align when said movable member is at various positions relative to said stationary member, and wherein said aligned holes receive a locking pin to fix the members together.

8. A clamp assembly as recited in claim 7, wherein said stationary member is a square cross-section tubular member having two pairs of opposed sides, and further comprising opposed, projecting feet extending from a first pair of said opposed sides, each of said feet defining at least one mounting hole.

9. A clamp assembly as recited in claim 8, wherein at least one of the other pair of opposed sides has no projecting foot, thereby permitting said stationary member to mount flush against a vertical surface.

10. A kit for a clamp assembly, comprising:

a clamp, including first and second jaws, at least one of said jaws being movable relative to the other;

an ear mounted on and projecting from said clamp, defining a pivot hole and an arcuate slot concentric with said pivot hole;

a movable mounting base portion, comprising a rectangular hollow tube defining spaced-apart holes, at least two of said holes aligning with said pivot hole and said arcuate slot;

a plurality of fasteners for fastening said ear to said movable mounting base portion through said aligned holes; and a plurality of stationary base members, each of said stationary base members sized to receive said movable base member with a telescoping fit, so that said stationary base members may be mounted at various locations, and said clamp and movable base member may be selectively mounted on the stationary base members, with said clamp both pivotable and vertically adjustable relative to the stationary base member on which it mounts.

11. A clamp assembly as recited in claim 6, wherein said arcuate slot defines a range of angular positions of said clamp relative to said movable member, and said locking fastener includes means for securing said clamp at any angular position within said range.

12. A clamp assembly as recited in claim 11, wherein said jaws are cushioned.

* * * * *